US005544601A

United States Patent [19]

Baba

[11] Patent Number: 5,544,601

[45] Date of Patent: Aug. 13, 1996

[54] SAFETY DEVICE FOR AN OVERLOCK SEWING MACHINE

[75] Inventor: Yasushi Baba, Tokyo, Japan

[73] Assignee: Juki Corporation, Tokyo, Japan

[21] Appl. No.: 363,865

[22] Filed: Dec. 27, 1994

[30] Foreign Application Priority Data

Dec. 27, 1993 [JP] Japan ..... 5-069950

[51] Int. Cl.[6] ..... D05B 83/00; D05B 69/36

[52] U.S. Cl. ..... 112/261; 112/162

[58] Field of Search ..... 112/260, 261, 112/168, 162, 443; 292/32, 36, 92, 167

[56] References Cited

U.S. PATENT DOCUMENTS

| | | | |
|---|---|---|---|
| 3,926,133 | 12/1975 | Herron et al. | 112/443 |
| 3,985,087 | 10/1976 | Herr et al. | 112/443 |
| 4,498,405 | 2/1985 | Hanyu et al. | 112/168 |
| 5,233,935 | 8/1993 | Winter | 12/261 X |
| 5,315,943 | 5/1994 | Sonada | 112/168 X |
| 5,388,540 | 2/1995 | Satoma | 112/261 X |

*Primary Examiner*—Ismael Izaguirre
*Attorney, Agent, or Firm*—Morgan, Lewis and Bockius LLP

[57] ABSTRACT

A safety device for an overlock sewing machine comprises: a way of selecting having an operating part located at which a loop cover covers, for selectively setting the operating part to a first mode set-up position to set up a first stitching mode using an auxiliary cloth table or to a second mode set-up position to set up the second stitching mode using a cloth waste cover, a way of contacting having an engaging part that may engage the operating part of the a way of selecting, the way of contacting being movably supported by the looper cover such that the engaging part is positioned in front of the second mode set-up position when the auxiliary cloth table is set to the looper cover, and that the engaging part is positioned in front of the first mode set-up position when the cloth waste cover is set to the looper cover, in the case that the engaging part comes in contact with the operating part, the way of contacting hindering the looper cover from turning toward a stand-up position thereof, and a way of operating coupled with the way of contacting so as to move the way of contacting when one of the auxiliary cloth table and the cloth waste cover is set to the looper cover.

5 Claims, 5 Drawing Sheets

SAFETY DEVICE FOR AN OVERLOCK SEWING MACHINE

BACKGROUND OF THE INVENTION

1. Field of Invention

The present invention relates to a safety device for preventing a worker from mistakenly operating an overlock sewing machine.

2. Description of the Conventional Art

In known overlock sewing machines, a cross-stitch S1 (as shown in FIG. 3) or a covering stitch S2 (as shown in FIG. 4) is selected according to the operation which is desired.

The conventional overlock sewing machine M of this type is illustrated in FIGS. 5 to 7.

A main body M1 of the overlock sewing machine, as well known, contains a lower looper Ld and an upper looper Lu, which cooperates with a needle N to form a stitch, a control mechanism for controlling the device of those loopers and the needle, a motor serving as a drive source, and the like.

A main body M1 of the overlock sewing machine is contoured by a main body cover 1, a looper cover 2, a cloth table 3, and the like. A cloth waste cover 4 (FIG. 5) or an auxiliary cloth table 5 (FIG. 6) is selectively set to the looper cover 2 and the cloth table 3 in accordance with the type of stitch to be formed. Specifically, to form the cross-stitch S1 (FIG. 3), the cloth waste cover 4 is set to the looper cover. To form the covering stitch S2 (FIG. 4), the auxiliary cloth table 5 is set to the looper cover.

To form the cross-stitch S1, it is necessary to operate the needle N, the upper looper Lu, and the lower looper Ld. To form the covering stitch S2, it is necessary to operate the needle N and the lower looper Ld. A selector D is provided to operate the sewing machine in accordance with the type of the stitch (the cross-stitch S1 or the covering stitch S2). To form the cross-stitch S1, the selector D is turned to a position S1 and the cloth waste cover 4 is set to the looper cover 2 as shown in FIG. 5. To form the covering stitch S2, the selector D is turned to a position S2, and the auxiliary cloth table 5 is set to the looper cover 2 as shown in FIG. 6. An auxiliary head plate **5*a* is fastened to the top surface 5*b* of the auxiliary cloth table 5. The auxiliary head plate 5*a*** is flush with a needle plate NB. With this, space of a stitching stage can be effectively used. Accordingly, it is possible to stitch a large cloth.

The looper cover 2 may be swung about an axis x between a stand-up position and a laid-flat position (FIG. 7). Usually, the looper cover 2 is urged in the direction that is opposite to the direction of an arrow in FIG. 7. When urged in that opposite direction, the looper cover 2 is prohibited from being swung. When moved in the direction of the arrow, it is allowed to be turned.

To operate the sewing machine, a worker sets the selector D to the position S1 or S2, sets the cloth waste cover 4 or the auxiliary cloth table 5 to the looper cover 2 in accordance with the selected position, and then closes the looper cover 2. Then, he starts the operation of the stitching operation.

In handling the overlock sewing machine, to change the cross-stitch S1 to the covering stitch S2, the worker operates the selector D for the stitch type change, and exchanges the cloth waster cover 4 with the auxiliary cloth table 5. However, an unskilled worker frequently starts the operation of the sewing machine while missing one of these procedural steps of operation. In this case, the sewing machine will form a stitch different from the desired one. In an extreme case, the machine will be broken.

For example, when the cross-stitch forming operation starts in a state that the auxiliary cloth table 5 is set to the looper cover, the upper looper Lu, which is vertically moving, hits the auxiliary cloth table 5. As a result, the upper looper Lu and/or the auxiliary cloth table 5 will be damaged or broken. Sometimes, broken pieces are scattered and injure hurt the worker.

SUMMARY OF THE INVENTION

The present invention has been made in view of the above circumstances and has an object to provide a safety device for an overlock sewing machine in which when the cloth waste cover or the auxiliary cloth table is improperly set to the looper cover in connection with the type of stitch selected, the sewing machine visually indicates the improper setting.

According to a first aspect, the present invention provides a safety device for an overlock sewing machine, the overlock sewing machine having a looper cover movable between a first position covering the front of the looper and a second position opening the front of the looper, an auxiliary cloth table removably attached to the looper cover, a cloth waste cover removably attached to the looper cover in place of the auxiliary cloth table, and at least two selectable stitching modes including a first stitching mode using the auxiliary cloth table and a second stitching mode using the cloth waste cover, the safety device comprising:

select means having an operating part located at which the looper cover covers, the select means for selectively setting the operating part to one of a first mode set-up position to set up the first stitching mode and a second mode set-up position to set up the second stitching mode;

contact means having an engaging part that may engage the operating part of the select means, the contact means being movably supported by the looper cover such that the engaging part is positioned in front of the second mode set-up position when the auxiliary cloth table is set to the looper cover, and that the engaging part is positioned in front of the first mode set-up position when the cloth waste cover is set to the looper cover, in the case that the engaging part comes in contact with the operating part, the contact means hindering the looper cover from turning toward a stand-up position thereof; and operating means coupled with the contact means so as to move the contact means when one of the auxiliary cloth table and the cloth waste cover is set to the looper cover.

According to a second aspect, the present invention provides a safety device for an overlock sewing machine, the overlock sewing machine having a looper cover movable between a first position covering the front of the looper and a second position opening the front of the looper, an auxiliary cloth table removably attached to the looper cover, a cloth waste cover removably attached to the looper cover in place of the auxiliary cloth table, and at least two selectable stitching modes including a first stitching mode using the auxiliary cloth table and a second stitching mode using the cloth waste cover, the safety device comprising:

select means, protruded to the front side of the overlock sewing machine, for selectively setting to one of a first stitching mode set-up position when the first stitching mode using the auxiliary cloth table is designated, and a second stitching mode set-up position when the second stitching mode using the cloth waste cover is designated;

contact means having an engaging part for hindering the lopper cover from moving toward the first position when the engaging part comes in contact with the select means set up at one of the first stitching mode set-up position and the second stitching mode set-up position, the contact means being supported by the looper cover so as to be movable to a position corresponding to the first stitching mode set-up position or the second stitching mode set-up position; and operating means coupled with the contact means, for moving the contact means to a first specific position when the auxiliary cloth table is set to the looper cover and to a second specific position when the cloth waste cover is set to the looper cover, wherein the engaging part is located in front of the second stitching mode set-up position when the contact means is moved to the first specific position, and the engaging part is located in front of the first stitching mode set-up position when the contact means is moved to the second specific position.

According to a third aspect, the present invention provides a safety device for an overlock sewing machine, the overlock sewing machine having a looper cover movable between a first position covering the front of the looper and a second position opening the front of the looper, an auxiliary cloth table removably attached to the looper cover, a cloth waste cover removably attached to the looper cover in place of the auxiliary cloth table, and at least two selectable stitching modes including a first stitching mode using the auxiliary cloth table and a second stitching mode using the cloth waste cover, the safety device comprising:

select means for selectively setting to one of a first stitching mode set-up position when the first stitching mode using the auxiliary cloth table is designated and a second stitching mode set-up position when the second stitching mode using the cloth waste cover is designated;

an engaging member provided on one side of the auxiliary cloth table; and contact means having an engaging part for hindering the lopper cover from moving toward the first position when the engaging part comes in contact with the select means set at one of the first stitching mode set-up position or the second stitching mode set-up position, and the operating means coupled with the engaging means such that the engaging part is moved to a position other than the first stitching mode set-up position by the engaging member when the auxiliary cloth table is set to the looper cover, and that the engaging part is moved to a position other than the second stitching mode set-up position when the cloth waste cover is set to the looper cover.

When the cloth waste cover (or the auxiliary cloth table) is set to the looper cover, if it is improper to a type of the stitch set by the select means, the contact piece of the looper cover comes in contact with the select means, thereby preventing the looper cover from being closed. Accordingly, the worker can visually recognize that the cloth waste cover that is set is improper to the selected stitch type, and no breakage of the machine takes place.

DETAILED DESCRIPTION OF THE PREFERRED EMBODIMENT

Figure 1:
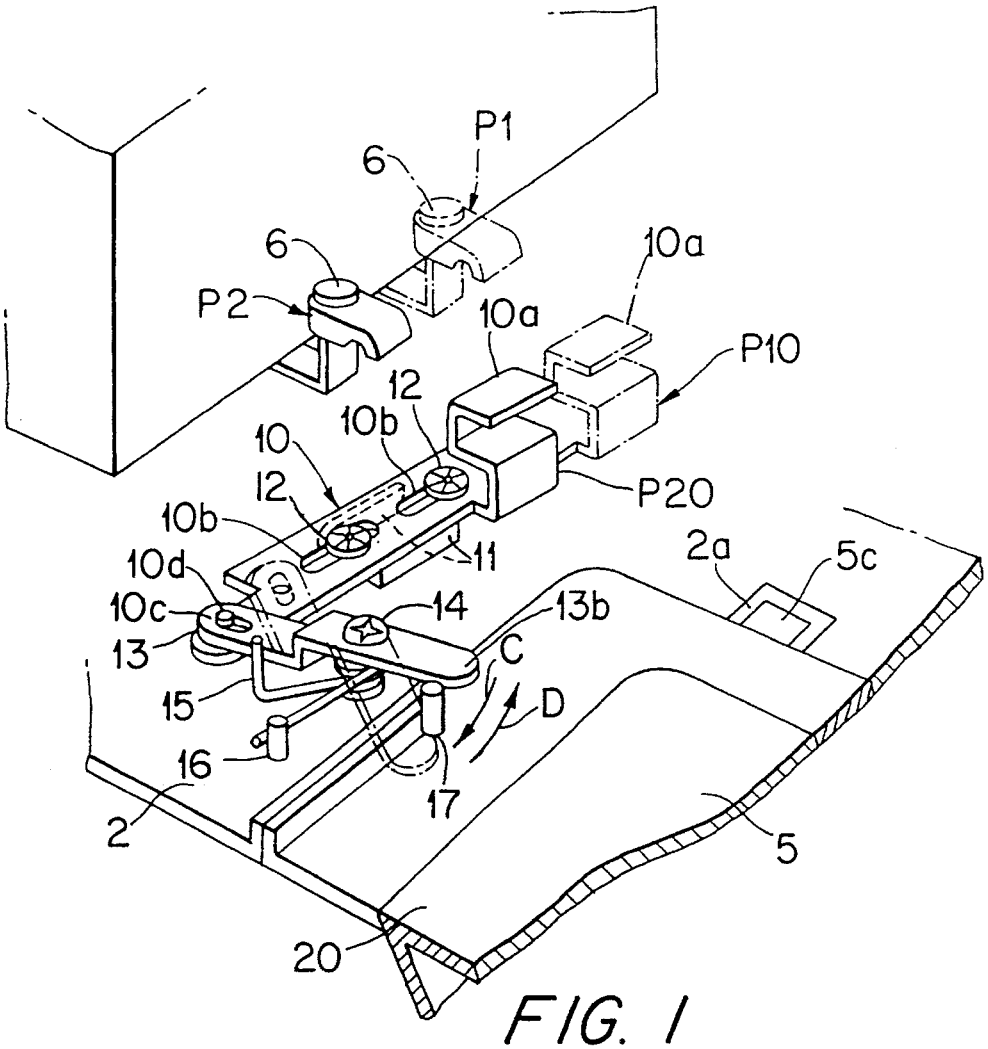
FIG. 1 is a perspective view showing an embodiment of a safety device for an overlock sewing machine according to the present invention.

The preferred embodiment of an overlock sewing machine according to the present invention will be described with reference to FIGS. 1 and 2. Throughout the drawings, like reference numerals designate like or equivalent portions.

A main body cover 1, a looper cover 2, a cloth table 3 and the like are mounted on a main body M1 of the overlock sewing machine M of the present invention. The contour of the main body M1 is substantially defined by those components. An auxiliary cloth table 5 or a cloth waste cover 4 may be removably set to the sewing machine.

A select lever 6 as select means is provided on the front side of the main body M1. The select lever 6 may be set to a first set position P1 indicated by a one-dot chain line and a second set position P2 indicated by a solid line. When it is set to the first set position P1, the machine performs the operation to form a covering stitch. When it is set to the second set position P2, the machine performs the operation to form a cross-stitch.

In the present embodiment, a mechanism as shown in FIG. 1 is provided on the rear side of the looper cover 2. The present embodiment is different from the conventional art in the provision of this mechanism.

In FIG. 1, reference numeral 10 designates a slide plate (contact member) mounted on the rear side of the looper cover 2, with a support plate 11 inserted therebetween. Elongated holes **10*b* are formed in the slide plate 10. Two guide screws 12, which protrude from the looper cover 2, are inserted into the elongated holes 10*b*, respectively. These guide screws 12 are slidable within the elongated holes 10*b* in parallel with the rear side of the looper cover 2 and the moving direction of the select lever 6. A contact piece 10*a* is extended from one end of the slide plate 10, and bent into a S-shaped cross section. The contact piece 10*a* is arranged in parallel with the rear side of the looper cover 2**.

Reference numeral 13 designates an operation link, which is rotatably supported at the mid portion thereof by a support shaft 14 standing upright on the rear side of the looper cover 2. An elongated hole **10*d* is formed in one end of the operation link 13. An engaging pin 10*c*, which stands erect on the other end of the slide plate 10, is loosely inserted into the elongated hole 10*d*. Reference numeral 15 designates a coiled spring wound around the support shaft 14. One extended end of the coiled spring 15 is pressed against a spring receiving part 16, while the other end thereof is pressed against the side edge of the operation link 13. The coiled spring 15 constantly urges the slide plate 10 in the direction of an arrow C, to put one end 10***a* of the slide plate 10 at a position (first contact position P10) indicated by a one-dot chain line. At the first contact position P10, the slide plate 10 comes into contact with the guide screws 12.

Figure 2:
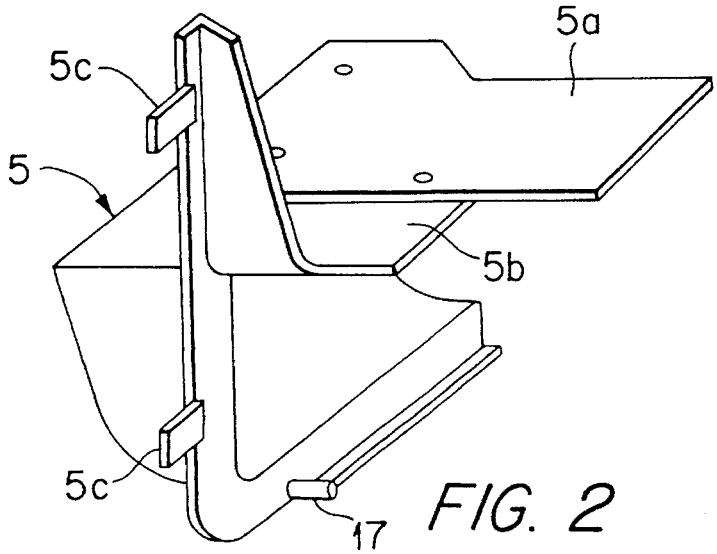
FIG. 2 is a perspective view showing an auxiliary cloth table used in the safety device of FIG. 1.
Figure 3:
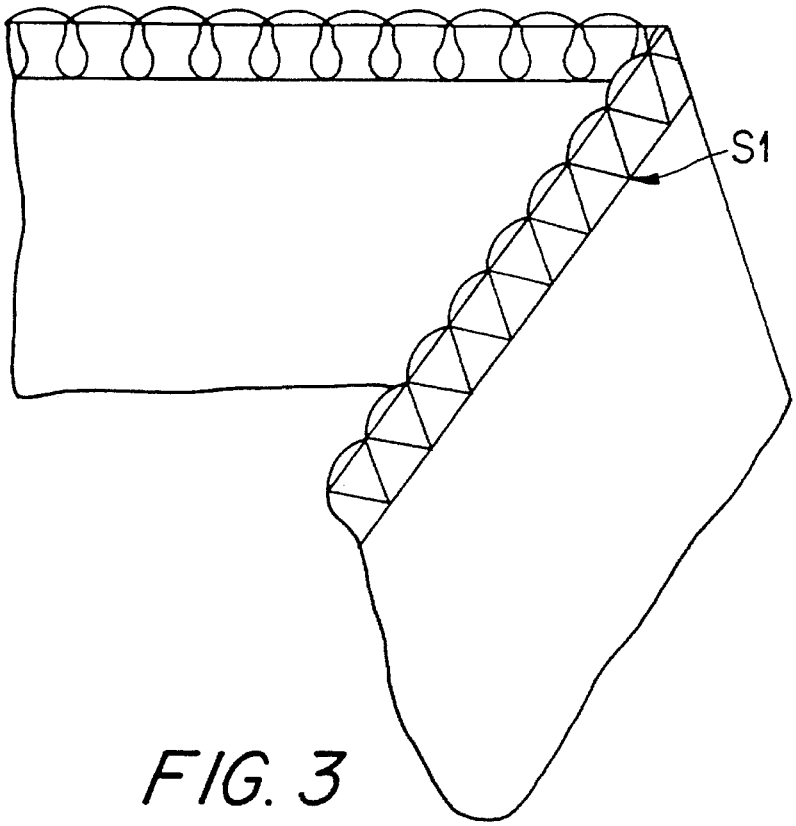
FIG. 3 is an explanatory diagram showing the front side and the back side of a cross-stitch.

As shown in FIG. 2, the auxiliary cloth table 5 is provided with a couple of plate-like protrusions 5*c*, and a pin-like protrusion 17. The plate-like protrusions 5*c* are respectively fit to a couple of grooves 2*a* of the looper cover 2 when it is set to the looper cover 2. The pin-like protrusion 17 extends toward the main body of the overlock sewing machine. When the auxiliary cloth table 5 is set to the looper cover 2, the pin-like protrusion 17 is located on the path of one end 13*a* of the operation link 13 when it is turned. The pin-like protrusion 17 pushes the operation link 13 while resisting the spring force of the coiled spring 15, so that the operation link 13 is turned from a position indicated by a one-dot chain line to another position indicated by a solid line (FIG. 1).

Figure 4:
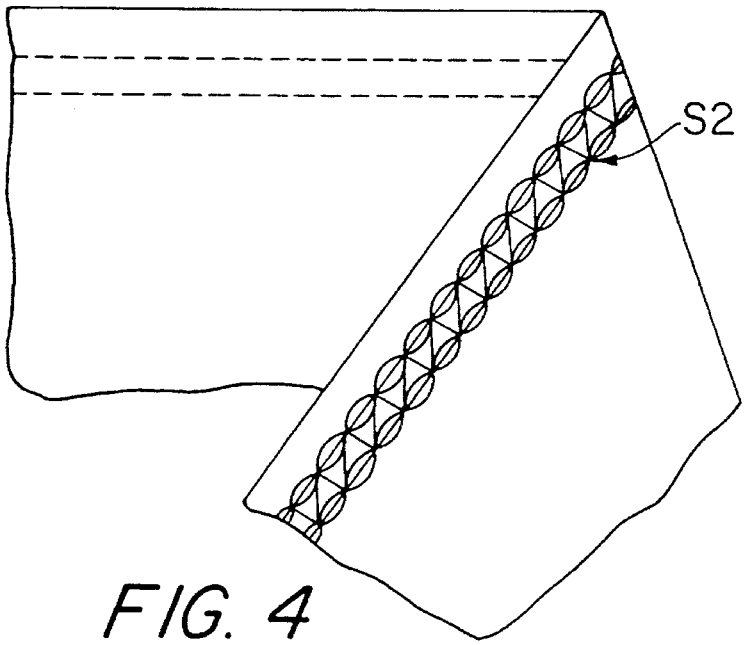
FIG. 4 is an explanatory diagram showing the front side and the back side of a covering stitch.
Figure 5:
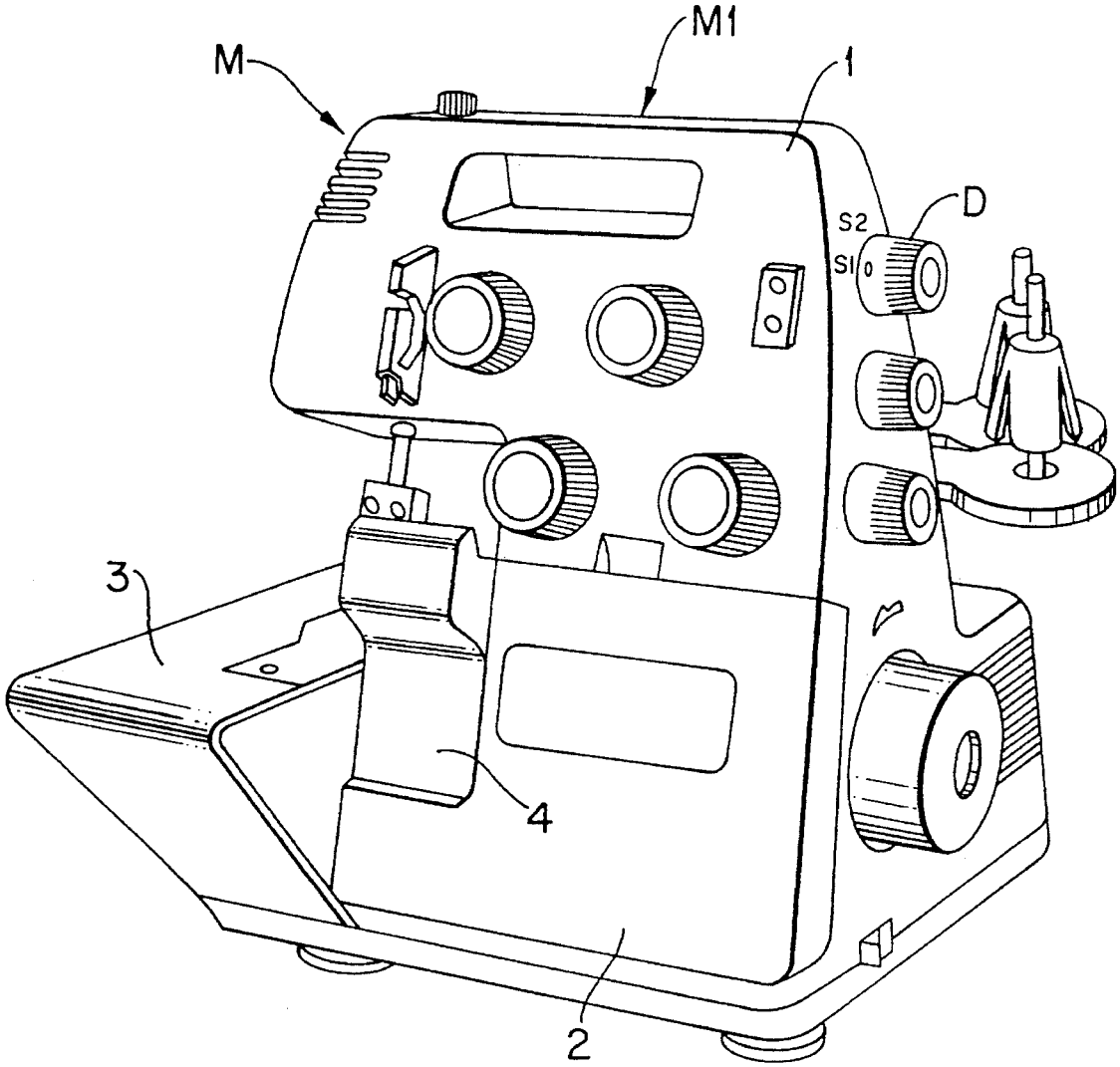
FIG. 5 is a perspective view showing an overlock sewing machine to which a cloth waste cover is set.
Figure 6:
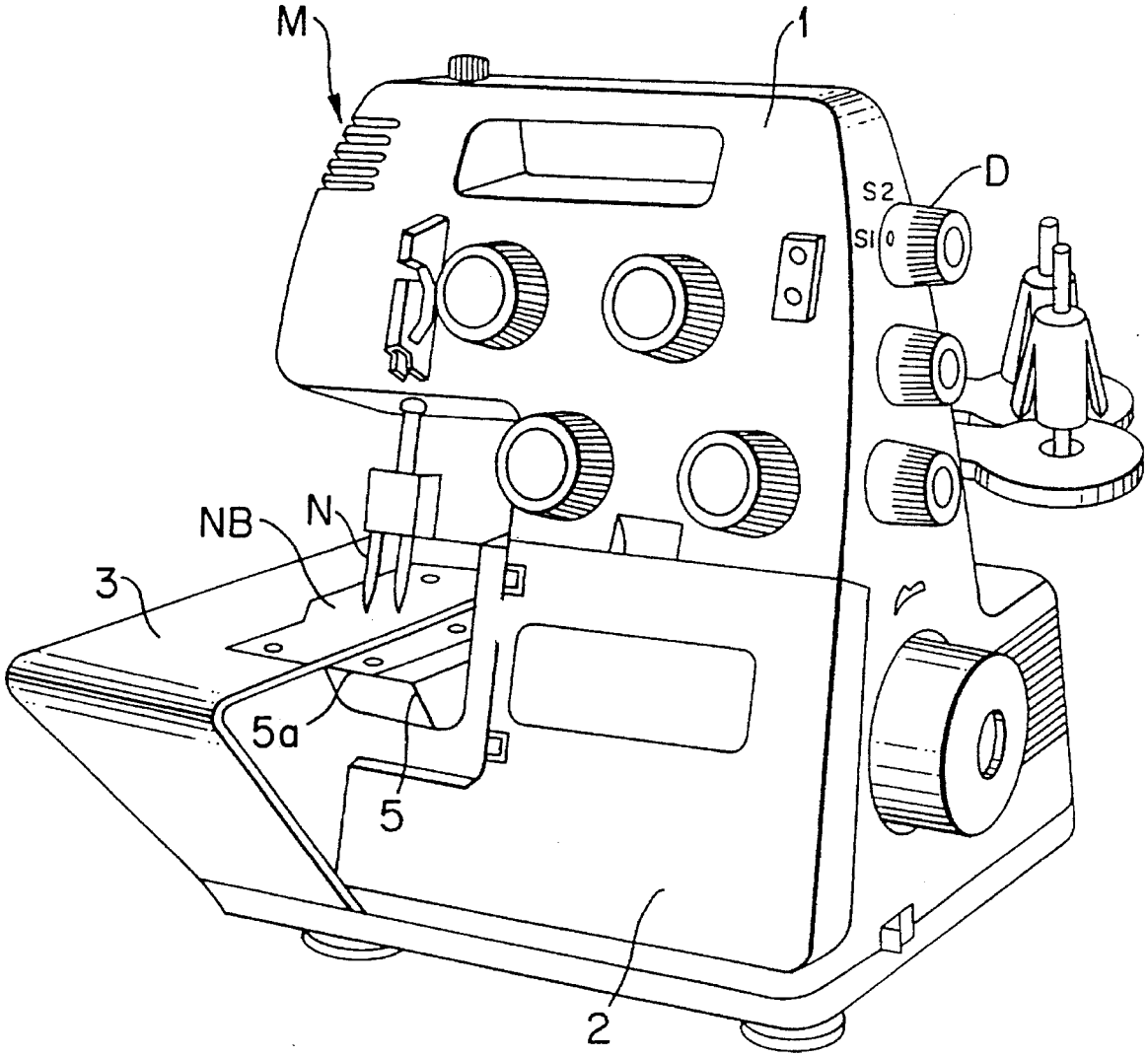
FIG. 6 is a perspective view showing an overlock sewing machine to which an auxiliary cloth table is set.

A switch (not shown) which operates when the looper cover 2 is opened and closed is used in this embodiment. The motor of the sewing machine is driven in response to a signal derived from this switch. When the looper cover is in an open state, the motor is prevented from turning;

To form a covering stitch as shown in FIG. 4 by using the overlock sewing machine with the safety device thus constructed, an operator opens the looper cover 2 up to the laid-flat position, sets the select lever 6 (provided on the front side M1*a* of the main body M1) to the first set position P1, and sets the auxiliary cloth table 5 to the looper cover 2. Then, the pin-like protrusion 17 extending from the auxiliary cloth table 5 turns the operation link 13 to a position indicated by a solid line. With the turn of the operation link 13, the slide plate 10 moves along the two guide screws 12.

Figure 7:
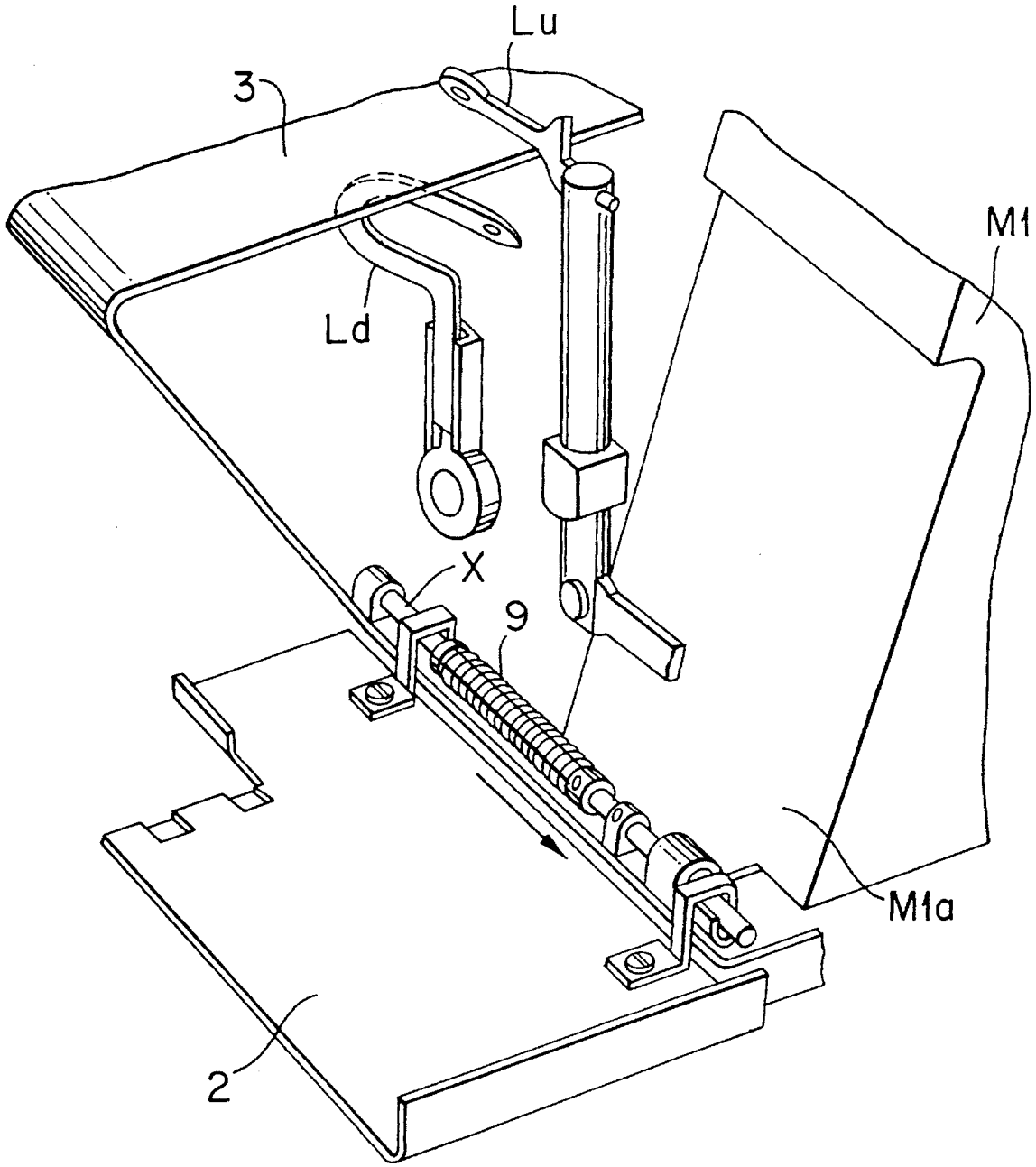
FIG. 7 PRIOR ART
FIG. 7 is a perspective view showing a a conventional overlock sewing machine when a looper cover is opened.

Thereafter, when an operator turns the looper cover 2 towards the upright, closed position, the looper cover 2 is smoothly turned up to the stand-up position or fully closed without any contact of the select lever 6 with the contact piece 10*a*. Its movement in the direction reverse to the arrow-head direction (FIG. 7) is allowed. Under this condition, if the operator issues a command to restart the stitching operation, the sewing machine performs the covering stitching operation.

To change the covering stitch to the cross-stitch, the operator opens the looper cover 2 up to the laid-flat position, sets the select lever 6 to the second set position P2, sets the cloth waste cover 4 to the looper cover 2, and finally closes the looper cover 2. Since the cloth waste cover 4 does not have a protrusion like that of the auxiliary cloth table 5, it does not act on the operation link 13. Accordingly, the operation link 13 and the slide plate 10 are both put at the position indicated by a one-dot chain line, by the spring force of the coiled spring 15.

In setting the cloth waste cover 4 to the sewing machine, the contact piece 10*a* of the slide plate 10 is put at the first contact position P10. Then, if the select lever 6 is set to the second set position P2, the select lever 6 will not contact the contact piece 10*a* when the looper cover 2 is turned for closing. Accordingly, also in this case, the looper cover 2 can be closed perfectly, ensuring a proper stitching operation by the machine.

As described above, when the cloth waste cover 4 (or the auxiliary cloth table 5) is set to the looper cover 2, if it is improper to a type of the stitch set by the select lever 6, the looper cover 2 cannot be closed perfectly.

In the case where the cloth waste cover 4 is set to the looper cover when the select lever 6 has been set to the first set position P1 for the covering stitch, the contact piece 10*a* of the slide plate 10 is put at the first contact position P10. Therefore, if the looper cover 2 is turned for closing, the contact piece 10*a* of the slide plate 10 comes in contact with the select lever 6, thereby allowing no further turn of the looper cover 2 for closing. In other words, the looper cover 2 cannot be closed perfectly.

Let us consider another case where the auxiliary cloth table 5 is set to the looper cover 2 when the select lever 6 has been set to the second set position P2. In this case, the contact piece 10*a* of the slide plate 10 is put at the second contact position P20 by the pin-like protrusion 17 of the auxiliary cloth table 5. Accordingly, when the looper cover 2 is turned for closing, the select lever 6 comes in contact with the contact piece 10*a* at a preset angle of the turn of the looper cover 2. No further turn of the looper cover 2 is allowed. Also in this case, the looper cover 2 cannot be closed perfectly.

As seen from the foregoing description, when an operator mistakenly sets the cloth waste cover 4 or the auxiliary cloth table 5 to the looper cover 2 in connection with the selected stitch type, he cannot fully close the looper cover. Accordingly, he can recognize this improper setting of the cloth waste cover or the auxiliary cloth table, from this fact. Further, the machine prohibits the motor for the sewing machine from being driven till the looper cover 2 is closed perfectly. In other words, the motor is never driven so long as the looper cover 2 is closed imperfectly. This advantageous feature of the invention provides a more reliable and safe machine.

In the embodiment of the present invention, when the auxiliary cloth table 5 is set to the looper cover 2, the operation link 13 is turned while resisting the spring force of the coiled spring 15. The embodiment of the invention may be modified such that when the cloth waste cover 4 is set to the lopper cover 2, the operation link 13 is turned while resisting the spring force of the coiled spring 15. The shapes and arrangements of the operation link 13 and the protrusions may variously be changed and modified within the scope of the present invention.

It is evident that the contact member is not limited to the slide plate 10. For example, a dial means may be used for the select means. It may take any form if it is movable between the first contact position P10 and the second contact position P20. In short, the moving means of the present invention is not limited to the above-mentioned one, but may be modified or changed variously.

In the above-mentioned embodiment, the cross-stitch and the covering stitch are assigned to the cloth waste cover and the auxiliary cloth table, respectively. If required, the winding stitch, decoration stitch, or the like may be assigned to the cloth waste cover, while the double loop stitch may be assigned to the auxiliary cloth table.

As described above, in the overlock sewing machine of the present invention, when the cloth waste cover (or the auxiliary cloth table) is set to the looper cover, if it is improper to a type of the stitch set by the select means, then the contact piece of the looper cover comes in contact with the select. Therefore, the looper cover is prevented from being closed. Accordingly, the worker can visually recognize that the cloth waste cover that is set is improper for the selected stitch type. No breakage of the machine takes place, and safety is improved.

What is claimed is:

1. A safety device for an overlock sewing machine, the overlock sewing machine having a looper cover movable between a first position covering the front of the looper and a second position opening the front of the looper, an auxiliary cloth table, a cloth waste cover, and at least two selectable stitching modes including a first stitching mode and a second stitching mode, said safety device comprising:

select means having an operating part located at which the lopper cover covers, said select means for selectively setting said operating part to one of a first mode set-up position to set up the first stitching mode and a second mode set-up position to set up the second stitching mode;

contact means having an engaging part that is structurally capable of engaging said operating part of said select means, said contact means being movably supported by the looper cover such that said engaging part is positioned in front of the second mode set-up position when the auxiliary cloth table is set together with the looper cover, and that said engaging part is positioned in front of the first mode set-up position when the cloth waste cover is set together with the looper cover, in the case that said engaging part comes in contact with said operating part, the contacting means hindering the looper cover from turning toward the first position thereof; and operating means coupled with the contact means so as to move the contact means when one of said auxiliary cloth table and said cloth waste cover is set to the looper cover.

2. A safety device for an overlock sewing machine, the overlock sewing machine having a looper cover movable between a first position covering the front of the looper and a second position opening the front of the looper, an auxiliary cloth table, a cloth waste cover, and at least two selectable stitching modes including a first stitching mode and a second stitching mode, said safety device comprising:

select means, protruded to the front side of the overlock sewing machine, for selectively setting to one of a first stitching mode set-up position when the first stitching mode using the auxiliary cloth table is designated, and a second stitching mode set-up position when the second stitching mode using the cloth waste cover is designated;

contact means having an engaging part for hindering the looper cover from moving toward the first position when said engaging part comes in contact with said select means set at one of the first stitching mode set-up position and the second stitching mode set-up position, said contact means being supported by the looper cover so as to be movable to a position corresponding to the first stitching mode set-up position or the second stitching mode set-up position; and operating means coupled with said contact means, for moving said contact means to a first set position when the auxiliary cloth table is set together with the looper cover and to a second set position when the cloth waste cover is set together with the looper cover, wherein said engaging part is located in front of the second stitching mode set-up position when said contact means is moved to the first set position, and said engaging part is located in front of the first stitching mode set-up position when said contact means is moved to the second set position.

3. A safety device for an overlock sewing machine, the overlock sewing machine having a looper cover movable between a first position covering the front of the looper and a second position opening the front of the looper, an auxiliary cloth table, a cloth waste cover, and at least two selectable stitching modes including a first stitching mode and a second stitching mode, said safety device comprising:

select means for selectively setting to one of a first stitching mode set-up position when the first stitching mode using the auxiliary cloth table is designated and a second stitching mode set-up position when the second stitching mode using the cloth waste cover is designated;

an engaging member provided on one side of the auxiliary cloth table; and operating means having an engaging part for hindering the looper cover from moving toward the first position when said engaging part comes in contact with said select means set at one of the first stitching mode set-up position or the second stitching mode set-up position, and said operating means coupled with an engaging means such that said engaging part is moved to a position other than the first stitching mode set-up position by said engaging member when the auxiliary cloth table is set together with the looper cover, and that said engaging part is moved to a position other than the second stitching mode set-up position when the cloth waste cover is set together with the looper cover.

4. A safety apparatus for a sewing machine which includes a looper cover, said safety apparatus comprising:

a selection device including an operating part for selectively setting one of at least two particular positions;

a contact device including an engaging part, wherein the contact device is movably supported by the looper cover and moveable to particular positions;

said selection device for selectively setting to one of a first mode set-up position to set up a first stitching mode using an auxiliary cloth table and a second mode set-up position to set up a second stitching mode using an cloth waste cover;

wherein said engaging part of said contact device is structurally capable of engaging said operating part of said selection device;

said contact device being movably supported by the looper cover such that said engaging part is positioned in front of the second mode set-up position when auxiliary cloth table is set together with the looper cover, and such that said engaging part is positioned in front of the first mode set-up position when the cloth waste cover is set together with the looper cover; and wherein said engaging part contacts said operating part, the contact device hinders the looper cover from turning toward a stand-up position thereof.

5. A safety apparatus for a sewing machine which includes a looper cover, said safety apparatus comprising:

a selection device including an operating part for selectively setting one of at least two particular positions;

a contact device being movably supported by the looper cover and moveable to particular positions;

said selection device for selectively setting to one of a first mode set-up position to set up a first stitching mode using an auxiliary cloth table and a second mode set-up position to set up a second stitching mode using an cloth waste cover;

wherein the contact device further includes an engaging part for hindering the looper cover from moving toward a stand-up position thereof when said engaging part comes in contact with said selection device set at one of the first stitching mode set-up position and the second stitching mode set-up position;

said contact device being supported by the looper cover so as to be movable to a position corresponding to the first stitching mode set-up position or the second stitching mode set-up position.

* * * * *